US005272795A

United States Patent [19]

Rothstein

[11] Patent Number: 5,272,795

[45] Date of Patent: Dec. 28, 1993

[54] JEWELRY CLASP

[76] Inventor: Lanny R. Rothstein, 1357 Azalea Dr., Jacksonville, Fla. 32205

[21] Appl. No.: 997,351

[22] Filed: Dec. 28, 1992

[51] Int. Cl.[5] ..... A44B 11/00

[52] U.S. Cl. ..... 24/616; 24/615; 63/6

[58] Field of Search ..... 24/616, 615, 116 A, 24/614, 625, 575, 597, 573.1; 63/6, 20

[56] References Cited

U.S. PATENT DOCUMENTS 2,952,058 9/1960 Geldwerth ..... 24/616
2,986,792 6/1961 Wyatt ..... 24/616
3,600,917 8/1971 Krock ..... 24/615
3,947,932 4/1976 Flynn ..... 24/616
4,520,537 6/1985 Valikon ..... 24/116 A
4,543,692 10/1985 Ode et al. ..... 63/20

*Primary Examiner*—Victor N. Sakran
*Attorney, Agent, or Firm*—Arthur G. Yeager

[57] ABSTRACT

Jewelry clasp comprising a male clasp member functioning as a leaf spring and a female clasp member to receive the leaf spring and be locked in place when fully inserted; and to be unlocked by manual finger pressure against the leaf spring device by access means which protect against unintentional unlocking pressure.

7 Claims, 2 Drawing Sheets

JEWELRY CLASP

BACKGROUND OF THE INVENTION

Bracelets and necklaces are normally provided with a clasp to close a strand of jewelry into a secure loop and yet be easily opened by finger manipulation. Sometimes the clasp includes a spring device to operate the opening and closing mechanism. None of these known devices has been completely satisfactory for a variety of reasons, e.g., the spring action has been weak and easy to overcome by tension applied to the jewelry string; casual movements of the human caused the spring catch to be released; or release mechanisms are too small to be easily manipulated.

It is an object of the present invention to provide a jewelry clasp which provides a secure lock which is easily released by fingertip pressure. It is another object of the invention to provide a jewelry clasp which has a spring release lock that is protected against casual unintentional release. Still other objects will appear from the more detailed description which follows.

BRIEF SUMMARY OF THE INVENTION

This invention relates to an openable and closeable jewelry clasp having a male member and a female member, the female member having a front wall and a bottom wall substantially mutually perpendicular to each other, the front wall of the female member having a passageway to receive a prong portion of the male member slidingly therethrough, the male member having a front wall attached substantially perpendicular to a bottom wall which extends rearwardly therefrom, the male member having an intermediate wall spaced above said bottom wall of the male member and being substantially parallel and closely adjacent the front wall of the male member. The male member has a slanted wall extending between the intermediate wall and the bottom wall of the male member, the bottom wall and the slanted wall forming a prong portion, the passageway includes a lower wide, generally rectangular, opening having a longer length and an upper narrow, generally rectangular, opening having a shorter length and being superposed on and communicating with said lower opening along their said lengths. The slanted wall of the male member has a pair of spaced notches adjacent the intermediate wall with the space between the notches being substantially the same as said length of the narrow opening, and the width of the bottom wall and the slanted wall of the male member being substantially the same as the length of the wide opening. The prong portion is insertable through the wide opening with the bottom of the walls male and female members being juxtaposed and the slanted wall being temporarily compressed toward the bottom wall of the male member, and when fully inserted, the slanted wall can expand away from the bottom wall of the male member because of the notches on the front wall of the female member adjacent respective ends of said narrow opening. The front walls of each of the male and female members has an access means for permitting selective access to the intermediate wall which can be depressed sufficiently to avoid the notches and allow the slanted wall to pass through the said lower opening unlocking the clasp.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The jewelry clasp of this invention is best understood by reference to the attached drawings.

Figure 1:
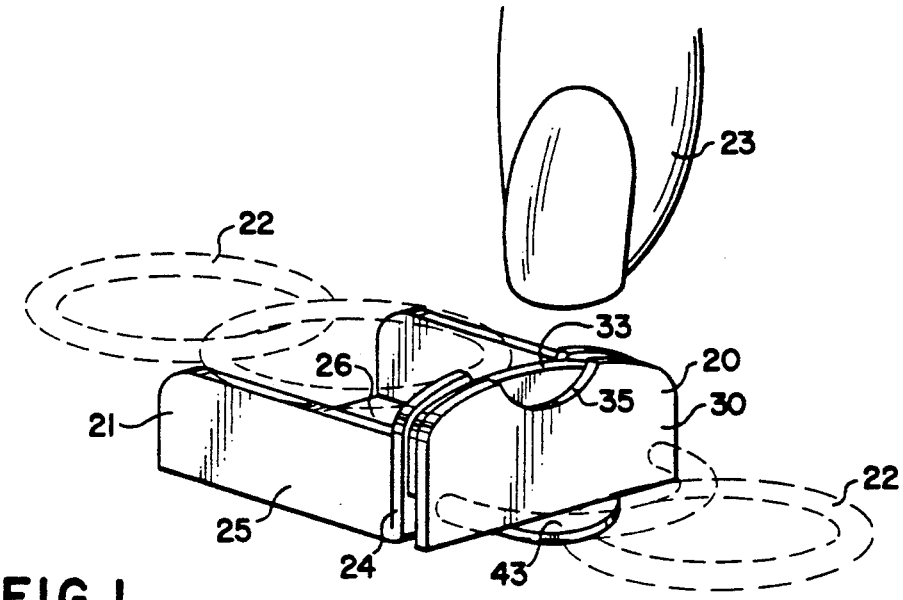
FIG. 1 is a perspective view of the jewelry clasp of this invention connected to a string of jewelry and about to be opened by the fingertip of a human.
Figure 2:
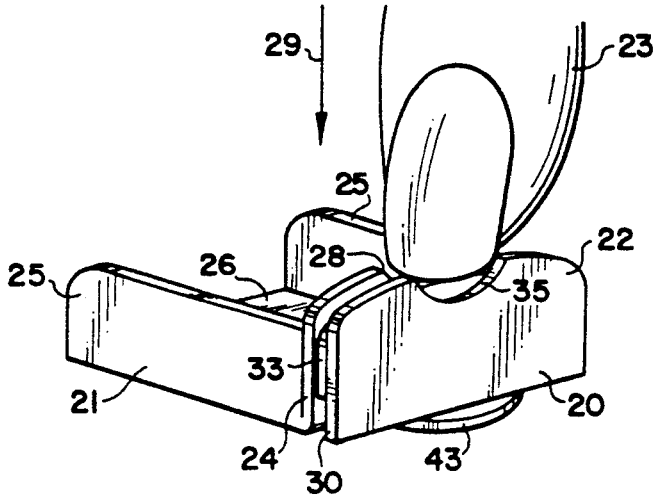
FIG. 2 is a perspective view similar to that of FIG. 1 wherein the fingertip is pressing on the release portion of the clasp.
Figure 3:
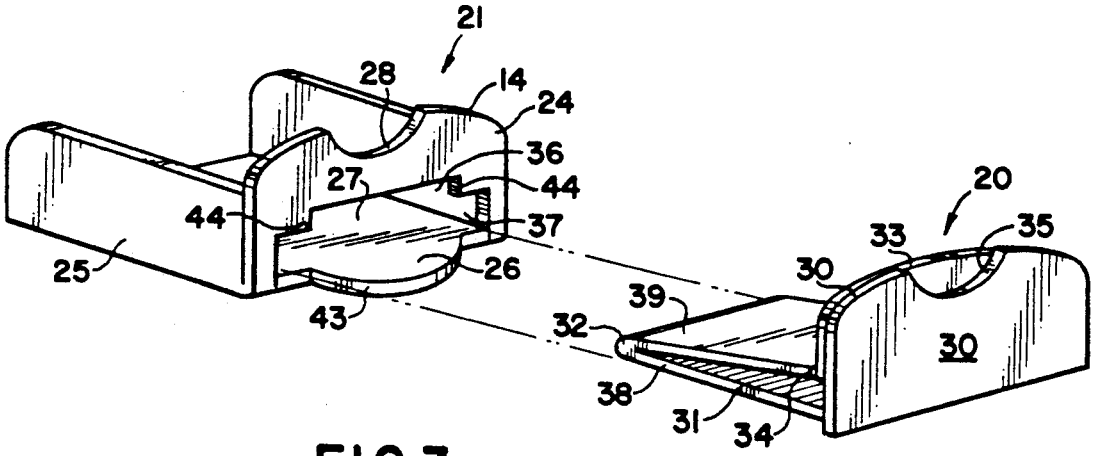
FIG. 3 is an exploded perspective view of the two portions of the jewelry clasp of FIG. 1.
Figure 4:
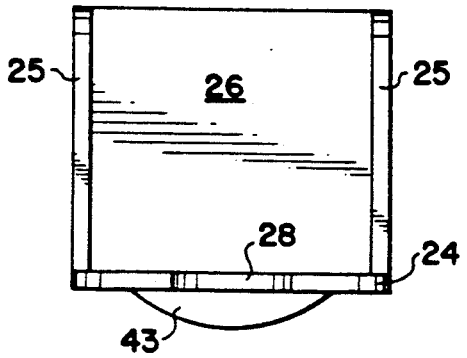
FIG. 4 is a top plan view of the female member of the jewelry clasp of this invention.
Figure 6:
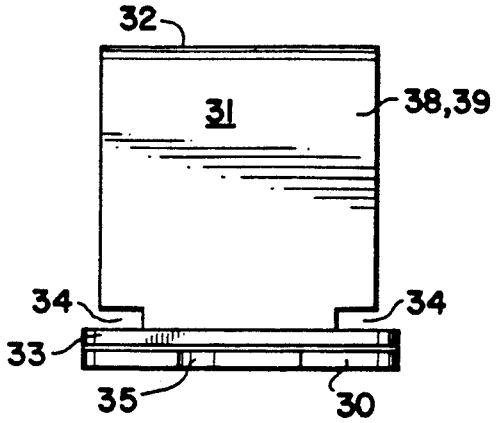
FIG. 6 is a top plan view of the male member of the jewelry clasp of this invention.
Figure 5:
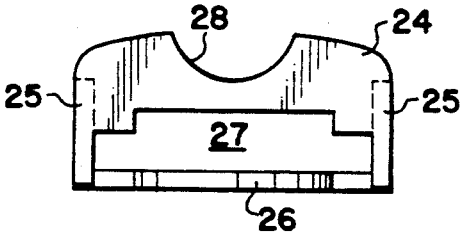
FIG. 5 is a front elevational view of the member of FIG. 4.
Figure 7:
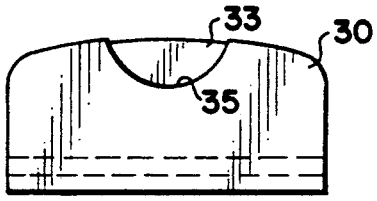
FIG. 7 is a front elevational view of the member of FIG. 6.

FIGS. 1-3 show the general structure and use of this invention.

The jewelry clasp joins two ends of a jewelry string 22 to make it into a bracelet or a necklace or a belt, or any other closed loop. Normally the ends of the jewelry string 22 are welded or soldered to the clasp or fastened to the clasp in any other secure manner, such as by screws. The clasp of this invention has two parts the male clasp member 20 and the female clasp member 21 which can be joined together into a locked position as shown in FIGS. 1-2 and may be released from that locked position by the pressure of a fingertip 23 to a vertically movable wall member 33 as shown in FIG. 2. How the locking and release is accomplished will be described below.

Female clasp member 21 is a structure of a vertical front wall 24 attached to at least one vertical side wall 25 and to horizontal bottom wall 26. Preferably, two vertical spaced side walls 25 are employed so as to provide a stronger and better looking clasp. These walls are mutually perpendicular and are fastened to each other so as to produce a rigid structure. Front wall 24 is pierced with a wide lateral opening or passageway 27 which is shaped to receive the penetrating portion of male clasp member 20, shown especially in FIG. 3. Opening 27 is in the shape of two rectangular spaces, a narrower space 36 superposed centrally on a wider space 37. The lateral widths of spaces 36 and 37 are coordinated with the widths of the prong portion of male clasp member 20. Space 37 is wide enough to permit male clasp member 20 to be inserted therein. Narrower space 36 is determined by the distance between notches 34 on male clasp member 20 as will be described later. The lower side of wider space 37 is closely adjacent to or identical with the upper surface of bottom wall 26, the latter alternative being preferable. Upper edge 41 of front wall 24 may be linear or arcuate, but preferably is smoothly convex and includes centrally thereof a fingertip notch 28 which is of a size and shape to receive a fingertip 23 as shown in FIG. 2. If desired, female clasp member 21 could include a vertical rear wall and/or a horizontal top wall so as to completely or partially enclose the interior space of the box-like clasp member. Bottom wall 26 is shown to include a forward rounded extension 43 which is not an essential part of this invention, but rather is a desirable inclusion serving as a guide for inserting male clasp member 20 into female clasp member 21.

Male clasp member 20 includes a front vertical wall 30, a bottom horizontal wall 31 and an intermediate vertical wall 33. Bottom wall 31 is rigidly attached at one end to front wall 30 and at the other end to intermediate wall 33. Bottom wall 31 is divided into two portions; horizontal portion 38 and slanting portion 39, these two portions joining at a reverse bend 32. This configuration bottom wall 31 forms a leaf spring whereby slanting portion 39 can be deflected toward horizontal portion 38, but when no deflecting force is used slanting portion 39 will be in the position shown in FIG. 3. When male clasp member 20 is inserted into female clasp member 21, slanting portion 39 will be deflected toward horizontal portion 38 by edges 44 as bottom wall 31 passes under space 37 of opening 27. At the rearward end of slanting portion 39 adjacent intermediate wall 33 are two notches 34 which release the deflection of slanting portion 39 and allow portion 39 to return to its relaxed position shown in FIG. 3. When this happens male clasp member 20 will be locked into female clasp member 21. Notches 44 are sized such that in the direction perpendicular to intermediate wall 33 the distance is slightly larger than the thickness of front wall 24 of female clasp member 21, and the lateral distance between notches 34 is slightly less than the lateral width of narrower portion 36 of opening 27. With these dimensions in mind it is clear that as soon as male clasp member is inserted far enough for notch 34 to clear front wall 24, slanting portion 39 will move upwards by its leaf spring power to a position as in FIG. 9 where male clasp member 20 cannot be withdrawn from female clasp member 21 until the connection is unlocked.

Figure 8:
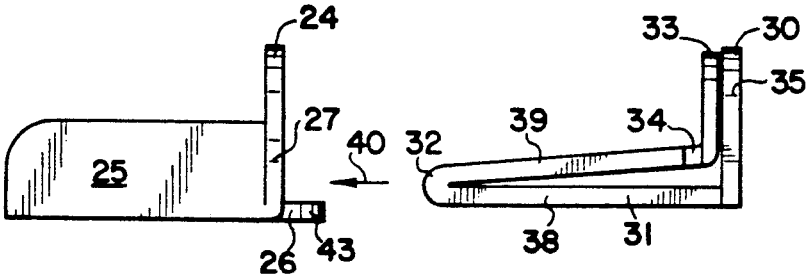
FIG. 8 is a side elevational view of the male and female member of the jewelry clasp separated and ready to be joined.
Figure 9:
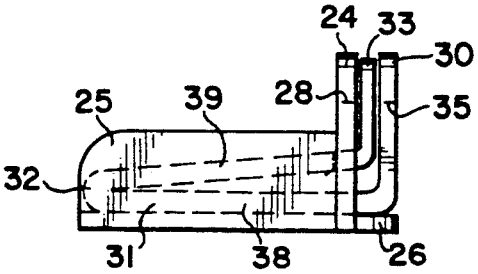
FIG. 9 is a side elevational view of the two members of FIG. 8 after being joined together in a locked condition.

Front wall 30 and intermediate wall 33 of male clasp member 20 are both smoothly rounded to provide a convex upper edge substantially similar to that of front wall 24 of female clasp member. Front wall 30 has a fingertip notch 35 substantially similar to notch 28 of front wall 24. When male clasp member 20 is inserted into female clasp member 21 by moving in the direction of arrow 40 in FIG. 8, the locked combination is as shown in FIG. 9. To unlock this combination the fingertip 23 is pressed downwardly on intermediate wall 33 which is sandwiched between front walls 24 and 30, respectively. Since both front walls 24 and 30 have fingertip notches 28 and 35, respectively, intermediate wall 33 can be pushed downwardly until the fingertip 23 reaches the bottom of notches 28 and 35. This travel of intermediate wall 33 is enough for slanting portion 39 to clear ledges 44 and to permit male clasp member 20 to be withdrawn from female clasp member 21, unlocking the clasp of this invention.

It is important that intermediate wall 33 be protected by front walls 24 and 30 of the female clasp member 21 and the male clasp member 20 in order to protect against unintentional unlocking of the clasp. The shape of walls 24, 30 and 33 is not important except that walls 24 and 30 must be similar along their edges where fingertip notches 28 and 35 are placed, and the edges of intermediate wall 33 must not extend above the edges of walls 24 and 30 except in the notches 28 and 35. This arrangement prevents unintentional unlocking except for the unlikely event of something pressing downwardly in the fingertip notches 28 and 35. These notches need not be in the center of the top edges of walls 24 and 30, but it is more convenient and better appearing to be in the center. The notches 28 and 35 may be off center, if they still serve to allow a fingertip to press down intermediate wall 33. If one wished to do so, notches 28 and 35 could be narrower than shown, and thereby require a finger nail to apply the pressure of unlocking.

The clasp of this invention is preferably made of metal, e.g., gold, silver, brass, copper, etc. although it may be made of suitable plastic materials. The sizes and shapes of the component parts are not critical since the clasp may be long and narrow, wide and short, curved, planar, or whatever the designer chooses.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A jewelry clasp comprising a female member and a male member having a releasable spring locking means for joining together and releasing from each other said male and female members; said female member including a vertical front wall perpendicular to two spaced vertical side walls, and a horizontal bottom wall perpendicular to both said side walls and said front wall, said front wall including a passageway therethrough to receive a prong portion of said male clasp member, said passageway being contiguous to said bottom wall and having the shape of a narrower generally rectangular space superposed on a wider generally rectangular space, said wider space being generally as wide as the lateral distance between said side walls, and said front wall including a concave first fingertip notch substantially the size and shape to receive a finger tip and located generally centrally of an upper extremity of said front wall; said male clasp member having a vertical front wall and a horizontal bottom wall attached perpendicularly thereto and extending rearwardly thereof to a reverse bend and thence extending forwardly by an upwardly slanting wall to a vertical intermediate wall spaced closely adjacent to said front wall of said male member, said horizontal bottom wall and said reverse bend and said slanting wall forming said prong portion of said male member, said horizontal wall having a lateral width slightly less than a width of said wider space of said passageway, said horizontal wall of the male member adjacent said intermediate wall including a pair of spaced notches respectively at each lateral extremity of said horizontal wall, said notches being spaced slightly less than a width of said narrower space of said passageway, said notches having a length in a rearward direction substantially equal to a thickness of said front wall of said female member whereby said notches may bridge said front wall of said female member when said clasp is closed, said front wall of said male clasp member including a second finger tip notch generally centrally of its upper extremity, and in alignment with said first finger tip notch, said intermediate wall having a length greater than said first and second notches and extending substantially to said upper extremity of said front wall of said male member.

2. An openable and closeable jewelry clasp comprising a male member and a female member, said female member having a front wall and a bottom wall substantially mutually perpendicular to each other, said front wall of said female member having a passageway to receive a prong portion of said male member slidingly therethrough, said male member having a front wall attached substantially perpendicular to a bottom wall thereof which extends rearwardly therefrom, said male member having an intermediate wall spaced above said bottom wall of said male member and being substantially parallel and closely adjacent said front wall of said male member, said male member having a slanted wall extending between said intermediate wall and said bottom wall of said male member, said bottom wall and said slanted wall forming said prong portion of said male member, said passageway including a lower wide, generally rectangular, opening having a longer length and an upper narrow, generally rectangular, opening having a shorter length and being superposed on and communicating with said lower opening along their said lengths, said slanted wall of said male member having a pair of spaced notches adjacent said intermediate wall with the space between said notches being substantially the same as said length of said narrow opening and the width of said bottom wall and said slanted wall of said male member being substantially the same as said length of said wide opening, said prong portion being inserted through said wide opening with said bottom walls of said male and female members being juxtaposed and said slanted wall being temporarily compressed toward said bottom wall of said male member, and when fully inserted, said slanted wall expands away from said bottom wall of said male member to dispose said notches on said front wall of said female member adjacent respective ends of said narrow opening, said front walls of said male and female members including upper edges of substantially equal heights and shapes, said intermediate wall having an upper edge at a height substantially equal to said heights of said upper edges of said front walls, each of said front walls having a notch aligned with each other generally medially of said upper edges, said notches permitting selective access to said intermediate wall whereby said intermediate wall is depressed sufficiently to dispose said slanted wall adjacent said notches in said lower opening whereby said clasp is in condition to be opened by a relative force between said male and female member extending generally along said bottom walls, said intermediate wall being substantially inaccessible outwardly of said clasp except for said aligned notches to inhibit inadvertent opening of said clasp.

3. The clasp of claim 2 wherein each said notch is concave, adapted to receive a fingertip of a user to engage said upper edge of said intermediate wall.

4. The clasp of claim 2 wherein said intermediate wall is sandwiched closely between said front walls of said male and female members, each of said notches having a predetermined length, said intermediate wall being larger in length than said predetermined length to enable said intermediate wall to span across said notches.

5. The clasp of claim 4 wherein each of said notches has a predetermined depth, said predetermined depth of said notch being at least equal to a depth of said narrow opening.

6. The clasp of claim 2 wherein said female member includes a pair of spaced side walls connecting said bottom wall to said front wall thereof.

7. The clasp of claim 2 wherein said clasp includes means for attaching said male and female members to ends of a jewelry strand.

* * * * *